US006715237B2

(12) United States Patent
Batt, Sr.

(10) Patent No.: US 6,715,237 B2
(45) Date of Patent: Apr. 6, 2004

(54) FLASHING ASSEMBLY

(76) Inventor: Dennis J. Batt, Sr., 9000 N. White Oak La., Bayside, WI (US) 53217

( * ) Notice: Subject to any disclaimer, the term of this patent is extended or adjusted under 35 U.S.C. 154(b) by 0 days.

(21) Appl. No.: 10/141,328

(22) Filed: May 7, 2002

(65) Prior Publication Data

US 2003/0208964 A1 Nov. 13, 2003

(51) Int. Cl.[7] ..... E04D 1/36

(52) U.S. Cl. ..... 52/11; 52/58; 52/62

(58) Field of Search ..... 52/60, 58, 62, 52/219, 11

(56) References Cited

U.S. PATENT DOCUMENTS

| | | | | | |
|---|---|---|---|---|---|
| 426,627 | A | | 4/1890 | Sagendorph | |
| RE17,818 | E | * | 9/1930 | Young | 52/61 |
| 1,833,730 | A | * | 11/1931 | Wood et al. | 52/62 |
| 2,203,312 | A | * | 6/1940 | Swenson | 52/62 |
| 3,281,997 | A | * | 11/1966 | Leonard | 52/57 |
| 3,300,913 | A | * | 1/1967 | Patry et al. | 52/58 |
| 3,812,634 | A | * | 5/1974 | Resech | 52/741.1 |
| 4,750,301 | A | | 6/1988 | Croxford | |
| 4,937,991 | A | | 7/1990 | Orth | |
| 4,951,431 | A | * | 8/1990 | Sweers | 52/58 |
| 5,065,553 | A | * | 11/1991 | Magid | 52/58 |

(List continued on next page.)

FOREIGN PATENT DOCUMENTS

| | | | |
|---|---|---|---|
| EP | 0616096 | A1 * | 9/1994 |
| EP | 0760044 | B1 * | 3/1997 |

OTHER PUBLICATIONS http://www.no–leak2002.com/instruction.html—"Installation Instructions Chimney Flashing Kit", pp. 1–2.
http://www.no–leak2002.com/brochure.html—"No Call Backs! with No Leak™ Chimney Flashing Kits", pp. 1 of 1.

*Primary Examiner*—Leslie A. Braun
*Assistant Examiner*—Ingrid Weinhold
(74) *Attorney, Agent, or Firm*—Boyle Fredrickson Newholm Stein & Gratz S.C.

(57) ABSTRACT

A flashing assembly used to construct a flashing around a building structure, such as a chimney. The assembly includes a pair of base flashing members including flexible end sections that can be deformed to adapt to the shape of a building structure around which the flashing is applied. Further, at least one of the base flashing members may also include a flexible center portion in order to allow the base flashing member to conform to a sloped surface or saddle positioned against one end of the building structure. The assembly further includes a number of conventional tin shingles that can be positioned between the base flashing members, and a number of counter flashing members that are positioned over the base flashing members and tin shingles to waterproof the flashing assembly. Each counter flashing member includes a locking receiver joint at one end that is adapted to receive and retain a locking flange formed opposite the locking receiver joint on an adjacent counter flashing member to secure the counter flashing members around the building structure over the base flashing members and tin shingles. The assembly enables an individual to quickly and effectively form and position a flashing around a building structure without requiring the individual to make complex bends in the components of the assembly. Each component of the assembly can also be placed within a kit used to form a complete flashing around the chimney.

24 Claims, 5 Drawing Sheets

U.S. PATENT DOCUMENTS 5,072,552 A 12/1991 Sauder
5,077,943 A * 1/1992 McGady ..... 52/58
5,381,632 A 1/1995 Damron
5,390,451 A 2/1995 Kopp et al.
5,553,425 A * 9/1996 Sampson et al. ..... 52/58
5,581,959 A 12/1996 Occhipinti
5,946,862 A * 9/1999 Hoffman ..... 52/58
5,946,863 A 9/1999 Bullard
5,970,667 A 10/1999 Thaler
6,035,587 A 3/2000 Dressler
6,073,418 A * 6/2000 Carroll ..... 52/746.11
6,108,981 A * 8/2000 Sama et al. ..... 52/60
6,122,874 A * 9/2000 Smerilli ..... 52/408
6,167,660 B1 * 1/2001 Sama ..... 52/58
6,327,820 B1 * 12/2001 Picco ..... 52/58
6,374,549 B1 * 4/2002 Mayle ..... 52/58
6,457,279 B1 * 10/2002 Jacobsen et al. ..... 52/58
6,543,187 B1 * 4/2003 Menzies ..... 52/58

* cited by examiner

FIG. 6
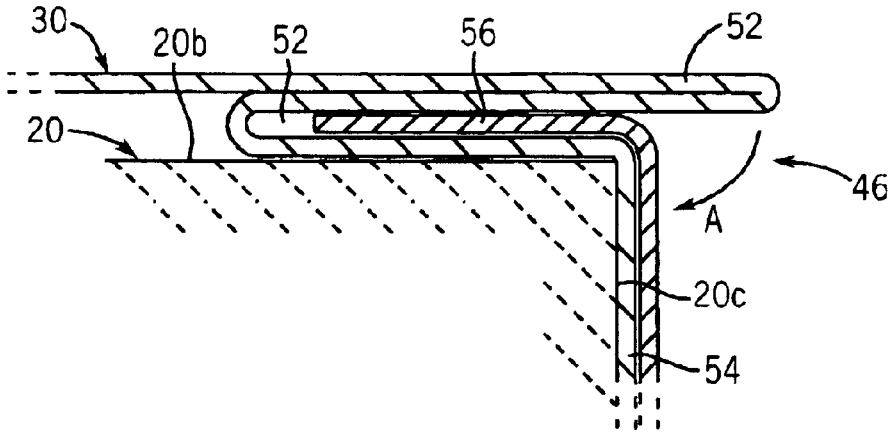
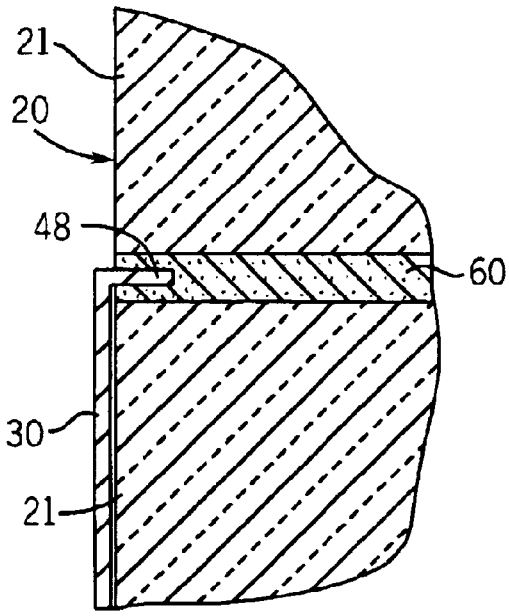
FIG. 7

FLASHING ASSEMBLY

FIELD OF THE INVENTION

The present invention relates to waterproofing building structures, and more specifically to a flashing kit utilized to waterproof the periphery of a building structure, such as a chimney.

BACKGROUND OF THE INVENTION

Flashings are normally utilized to waterproof the periphery of a building element extending outwardly and/or upwardly from the building structure, such as a chimney. Flashings are often utilized on chimneys which protrude out of a sloped roof of the building, such that the chimney defines a top end near the apex of the roof, a bottom end opposite the top end and a pair of side ends extending between the top and bottom ends.

The flashing including three types of parts, namely, base flashing members, counter flashing members, and a number of tin shingles. To assemble the flashing around the chimney, initially the base flashing members are placed against the top and bottom ends of the chimney. The tin shingles are then positioned along each side of the structure between the base flashing members, such that the shingles extend partially beneath the roofing shingles. Finally, the counter flashing members are placed over the base flashing members and the tin shingles, and sealingly engaged with the chimney to waterproof the exterior of the building chimney around which the flashing is placed.

The parts of the flashing are formed from flat sheet metal pieces present at the site of the building. To form the flashing members into the proper shape and configuration to accommodate the chimney being waterproofed, each of the flashing parts, must be cut to the appropriate length and width from the pieces of sheet metal at the job site. Each part must also be individually bent in order to size the flashing members to the chimney. Thus, on most occasions, the flashing members are custom made on the job site.

In order to appropriately size the flashing members on the job site to fit the particular chimney or other structure being waterproofed, one or more bending tools, such as a sheet metal brake, are required. These tools are quite expensive, and require a large amount of experience in order to be utilized properly to form the appropriate bends in the respective flashing members. Furthermore, as each of the base flashing members and counter flashing members are formed independently of one another, it is also necessary to be able to solder or otherwise attach each of the flashing members to one another in order to form the waterproof seal about the chimney after placing the members around the structure.

To make the application of the flashing members around a chimney or other building structure easier, a corrugated corner base flashing member has been developed which can be attached at each end of the base flashing members. The configuration of this corner flashing member allows it to be easily deformed around the corner of a structure to enable the base flashing member to more easily conform to the shape of the structure.

While this corner flashing member eliminates the need for the use of a tool to bend a base flashing member to conform to a corner of the structure, the corner flashing members are separate pieces and must still be soldered or joined to the base flashing member and tin shingles positioned on either side of the corner flashing member in order to provide the proper attachment between these pieces to form the waterproof seal. Also, because the corrugated corner base flashing members are separate pieces, the base flashing members, the counter flashing members and the shingles must still be made, i.e. cut, bent and attached to the corrugated pieces and to one another in order to form the appropriate flashing for a given structure.

As a result, it is desirable to develop a flashing system or kit that includes preconfigured components which easily conform to the shape of a structure around which the flashing is to be applied. Furthermore, it would also be desirable to develop a flashing kit in which one or more of the flashing members can be secured to one another using preformed connections on the respective flashing members.

SUMMARY OF THE INVENTION

It is an object of the present invention to provide a flashing assembly formed of flashing parts that are pre-shaped to be easily conformable to the shape of a building structure to be enclosed by the flashing.

It is still another object of the invention to provide a flashing assembly including a number of base flashing members that are readily deformable to conform to the configuration of the building structure and the roof from which the building structure extends.

It is still a further object of the invention to provide a flashing assembly with a number of counter flashing members including preformed locking receiver joints that enable the counter flashing members to be quickly and reliably secured to one another.

It is still another object of the present invention to provide a flashing assembly that can be sold as a kit which includes base flashing members, tin shingles, and counter flashing members having the desired color and formed of the desired material.

It is still a further object of the invention to provide a flashing assembly sold as a kit in which the respective flashing members contained within the kit are pre-sized to fit building structures having specific dimensions.

The present invention is a flashing assembly for waterproofing the periphery of building structures, such as chimneys that can be sold as a unitary kit. The assembly includes a number of pre-bent base flashing members, tin shingles, and of counter flashing members. Each of the base flashing and shingle members included in the assembly is pre-bent to conform to a predefined angle existing between the building structure and the roof such that each member can be immediately placed against the structure without having to use conventional tools to bend these members on the job site.

Each of the base flashing members is formed from a generally rigid material, such as a piece of sheet metal, and includes a pair of corrugated sections integrally formed at each end of the base flashing member. The corrugated sections allow each end of the base flashing member to flex and conform to the shape of the corners of the building structure against which the base flashing member is positioned, such that the base flashing member does not need to be bent by the individual applying the base flashing using conventional tools, such as a sheet metal brake. Further, one of the base flashing members includes a center corrugated section disposed between the corrugated end sections that enables the base flashing member to conform to the shape of a slanted surface adjacent the structure, such as a saddle positioned on a roof against the top end of a chimney. With the corrugated center section present, the base flashing member does not need to be bent along its center using conventional tools in order to conform to the shape of the saddle. After the base flashing members are positioned against opposite ends of the surface, the tin shingles can be placed between the base flashing members along the sides of the structure in a conventional manner.

The flashing assembly also contains a number of counter flashing members adapted to be positioned around the building structure over the base flashing members and tin shingles. The counter flashing members each include a locking receiver joint at one end that can receive and engage an aligning tab or flange formed on an adjacent counter flashing member. Each locking receiver joint includes a slot in which the flange can be received and a locking tab that is pivotable over the slot once the flange is received within the slot. In this manner, each of the counter flashing members can be securably attached to one another around the building structure over the base flashings and the tin shingles without the need for any additional securing means other than the counter flashing members themselves.

Once the counter flashing members are secured to one another, the counter flashing can be waterproofed, or sealed with respect to the building structure by providing a sealing element along the top edge of each counter flashing member opposite the roof. The sealing element is an upwardly and angularly extending flange between which can be positioned in engagement with a sealing substance disposed on the structure, such as a caulk, or which can be directly affixed to the building structure.

Various other features, objects and advantages of the invention will be made apparent from the following detailed description taken together with the drawings.

BRIEF DESCRIPTION OF THE DRAWINGS

The drawings illustrate the best mode currently contemplated of practicing out the invention.

In the drawings:

FIG. 6 is a cross-sectional view along line 6—6 of FIG. 2;

FIG. 7 is a cross-sectional view illustrating an alternative sealing configuration for the assembly of FIG. 1;

DETAILED DESCRIPTION OF THE INVENTION

Figure 1:
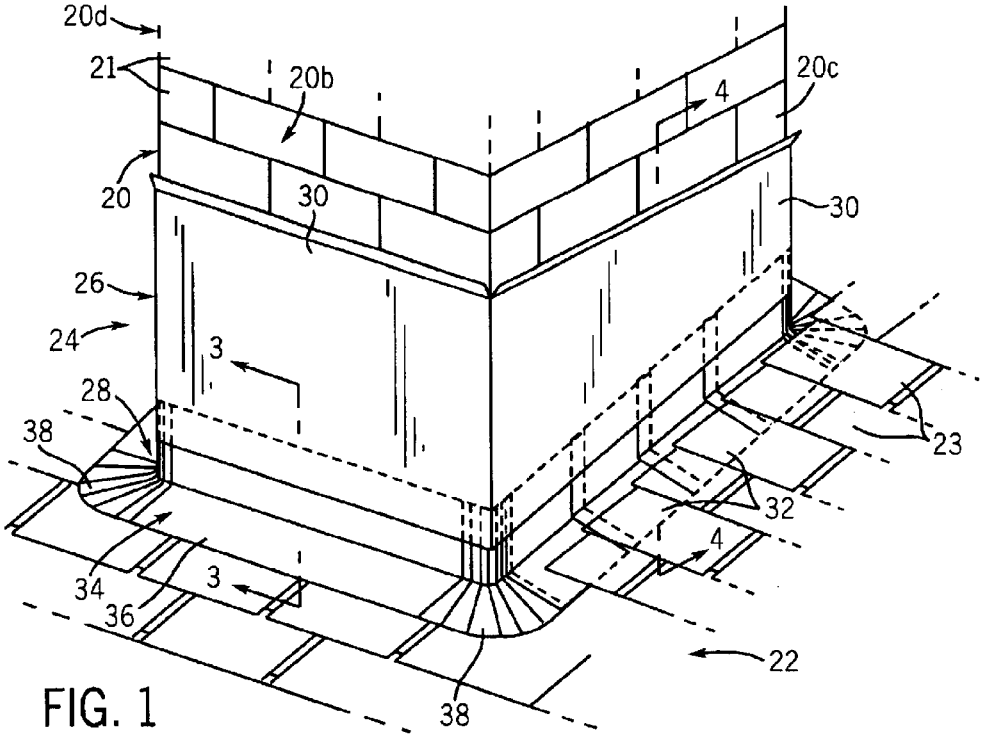
FIG. 1 is an isometric view of the flashing assembly of the present invention assembled around the front end of a chimney.

With reference now to the drawing figures in which like reference numerals designate like parts throughout the disclosure, a building structure, i.e., a chimney 20, formed from a number of bricks 21, is shown extending upwardly from a sloped roof 22 having a number of roofing shingles 23 in FIG. 1. The chimney 20 includes a top end 20*a*, a bottom end 20*b* and a pair of sides 20*c* and 20*d* extending between the top end 20*a* and the bottom end 20*b*, and is surrounded by a flashing assembly 24. The flashing assembly 24 includes a counter flashing assembly 26, and a base flashing assembly 28 that can be contained within a unitary kit.

Figure 8:
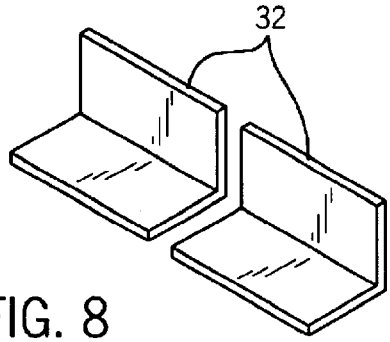
FIG. 8 is an isometric view of a number of tin shingles included in the flashing assembly of FIG. 1.
Figure 9:
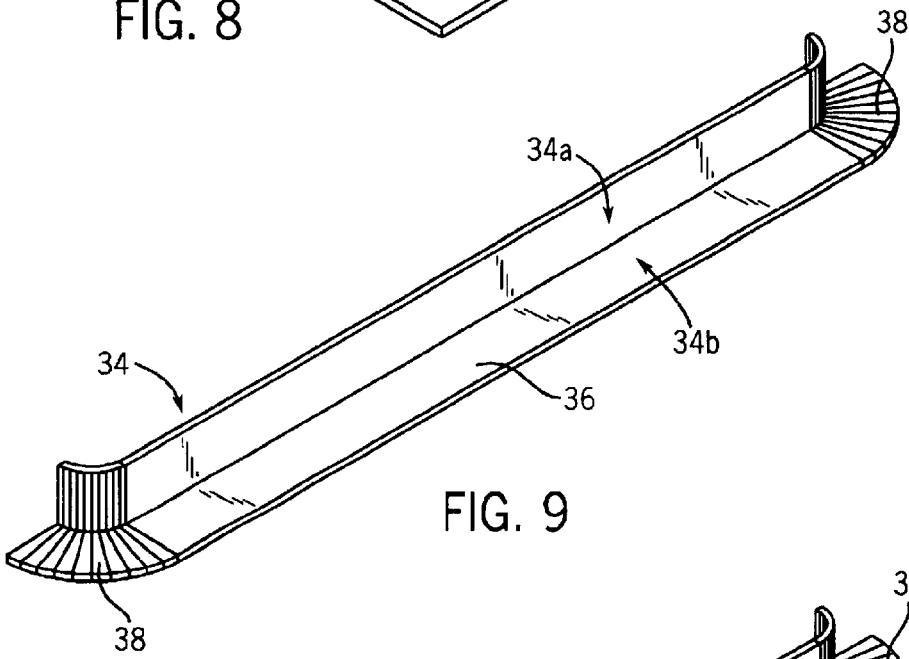
FIG. 9 is an isometric view of a first base flashing member of the flashing assembly of FIG. 1.
Figure 10:
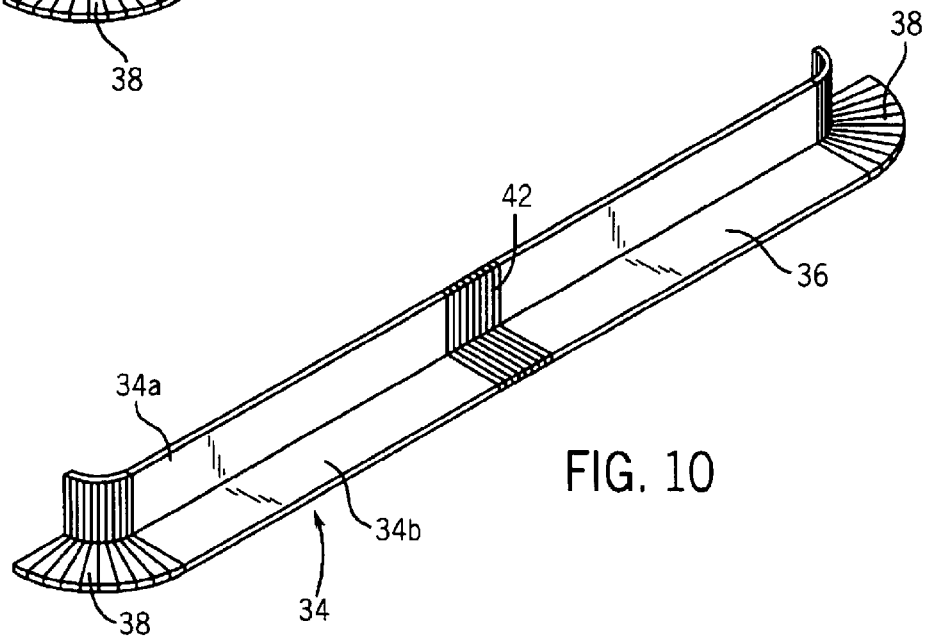
FIG. 10 is an isometric view of a second base flashing member of the flashing assembly of FIG. 1.

As best shown in FIGS. 8–10, the base flashing assembly 28 includes a number of shingles 32 and a pair of base flashing members 34. The base flashing members 34 each are bent along a longitudinal centerline to a predetermined angle between the respective halves 34*a* and 34*b* of each member 34. This angle is preformed to correspond to the angle between the roof 22 and the chimney 20 created by the slope of the roof 22. Alternatively, the members 34 can be bent to an angle of approximately 90° such that the angle can be adjusted on the job site in order to conform the base flashing members 34 to the angle present between the chimney 20 and the roof 22 at each end of the chimney 20.

Figure 5:
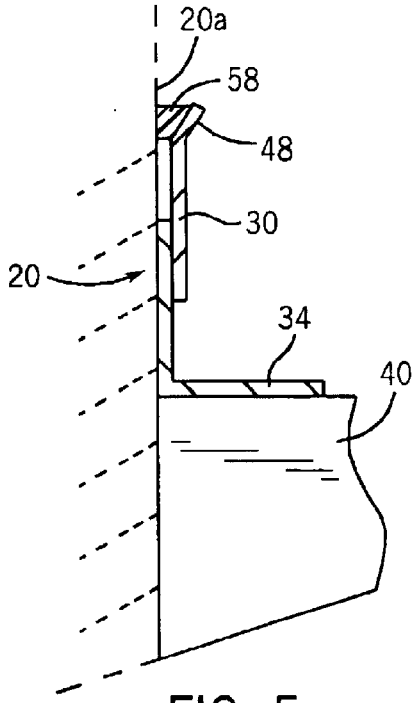
FIG. 5 is a cross-sectional view along line 5—5 of FIG. 2.

Each base member 34 has a central section 36 that is connected to a corrugated end portion 38 at each end. The end portions 38 can be attached to the central section 36 by welding, or adhesively adhering each end portion 38 to the central section 36. Alternatively, in a preferred embodiment, the end portions 38 are integrally formed with the central section 36 in a known manner. Each corrugated end portion 38 can be deformed around the corner of the chimney 20 in order to enable the base flashing members 34 to fit snugly against top end 20*a* and bottom end 20*b* of the chimney 20 and over the roofing shingles 23, as shown in FIGS. 3 and 5. With this configuration for the base flashing member 34, the member 34 can be immediately placed against each end of the chimney 20 upon removal from the kit and adjusted in shape to conform to the corners of the chimney 20 and the slope between the chimney 20 and the roof 22, as best shown in FIGS. 1 and 2.

Figure 2:
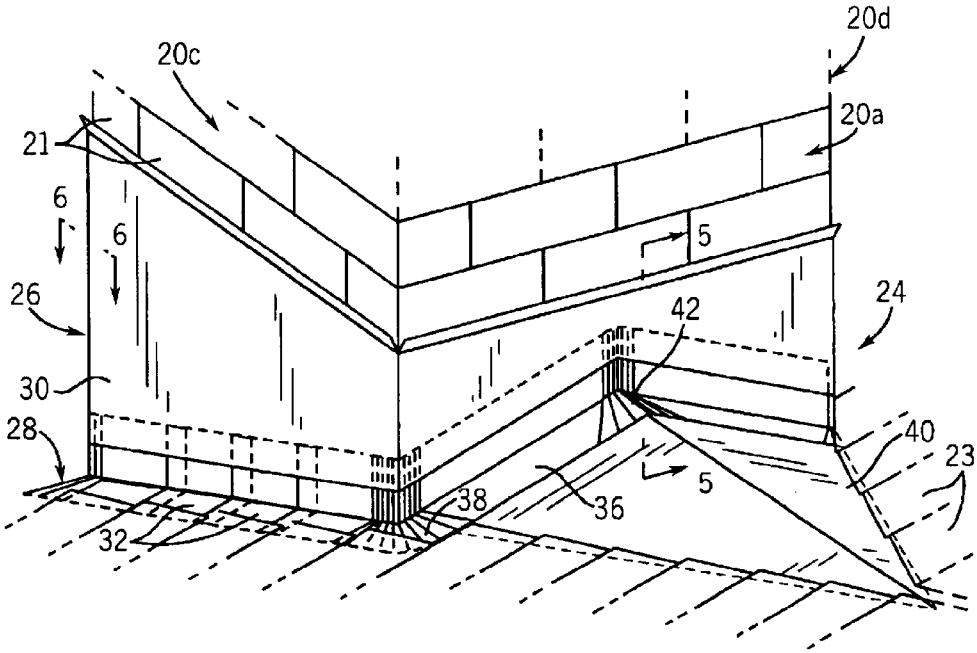
FIG. 2 is a rear isometric view of the flashing assembly of FIG. 1 assembled around a rear end of the chimney.
Figure 3:
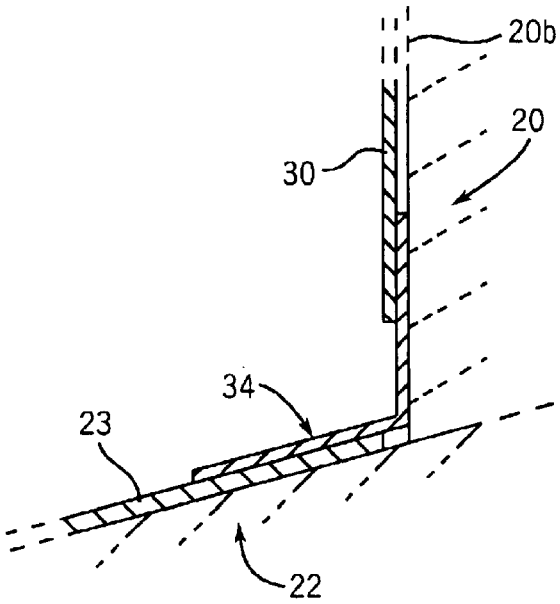
FIG. 3 is a cross-sectional view along line 3—3 of FIG. 1.

Furthermore, in order to accommodate chimneys 20 which include a saddle 40 extending outwardly from the top end 20*a* of the chimney 20 along the roof 22 in order to divert precipitation towards the sides 20*c* and 20*d* of the chimney 20, as shown in FIGS. 2 and 5, one of the base flashing members 34 may also include a corrugated center portion 42 disposed on the central section 36 between the corrugated end sections 38. When the base flashing member 34 containing the corrugated center portion 42 is positioned against the top end 20*a* of the chimney 20 and over the saddle 40, the center portion 42 can be deformed to enable the central section 36 of the base flashing member 34 to conform to the shape of the saddle 40.

Figure 4:
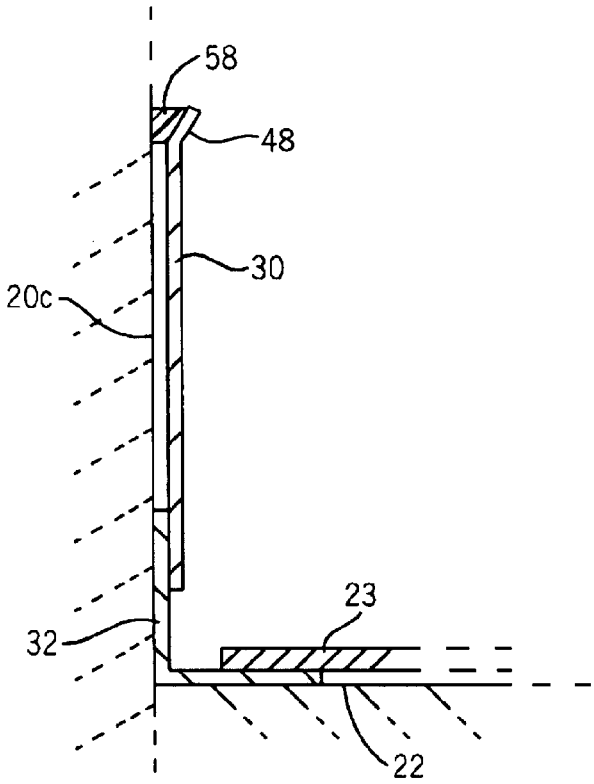
FIG. 4 is a cross-sectional view along line 4—4 of FIG. 1.

After the base flashing members 34 have been positioned against the top end 20*a* and bottom end 20*b* of the chimney 20, the shingles 32, best shown in FIGS. 1, 2 and 8, are positioned against the sides 20*c* and 20*d* of the chimney 20 between the corrugated end portions 38 of each base flashing member 34 as illustrated in FIGS. 1 and 2. The tin shingles 32 are also initially formed with a bend between the respective halves of the tin shingles 32 similar to the bend in the base flashing members 34, such that the shingles 32 can be immediately placed against the chimney 20 and the roof 22 between the base flashing members 34 with little, if any adjustment to the configuration of the shingles 32. The shingles 32 are positioned in abutment with one another along each side end 20*c* and 20*d* of the chimney 20 with one half of each shingle 32 positioned flush with each of the sides 20*c* and 20*d*, and the other half positioned beneath the roofing shingles 23 attached to the roof 22, as best shown in FIG. 4. Based on the overall width of the shingles 32, it may be necessary to trim one or more of the shingles 32 in order to obtain an appropriate fit for the singles 32 between the base flashing members 34.

Figure 11:
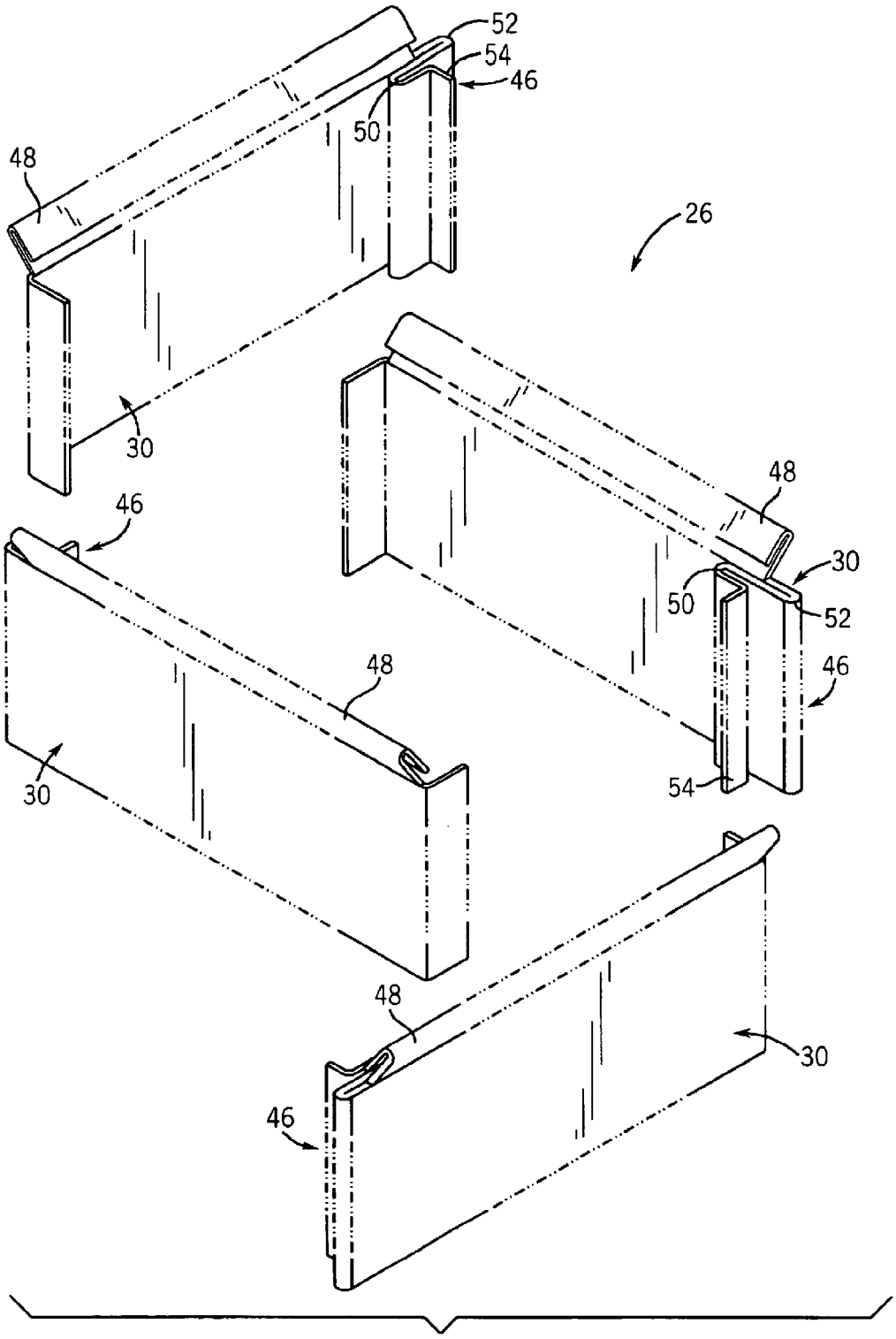
FIG. 11 is an isometric view of one embodiment of the counter flashing members of the flashing assembly of FIG. 1.

Referring now to FIGS. 1–2 and 11, the counter flashing assembly 26 is shown comprising four separate counter flashing members 30 positioned against each end of the chimney 20. The counter flashing members 30 are each formed from a sheet of a semi-rigid material similar to the base flashing assembly 28, such as a metal, and include a locking receiver joint 46 fixedly attached to or integrally formed with one end. Further, each counter flashing member 30 also includes a sealing flange 48 integrally formed with and extending the width of the counter flashing member 30 along a top end thereof.

As best shown in FIG. 6, each locking receiver joint 46 includes a receiving slot 50 positioned on one side of the counter flashing member 30, a locking tab 52 extending outwardly from the counter flashing member 30 adjacent the slot 50, and an aligning flange 54 connected to the receiving slot 50 opposite the locking tab 52 and extending outwardly perpendicular to the counter flashing member 30. The receiving slot 50, locking tab 52 and aligning flange 54 are preferably integrally attached to one another and are formed by bending one end of each counter flashing member 30 into a configuration where the receiving slot 50, locking tab 52 and aligning flange 54 are formed as shown in FIG. 6.

In order to properly position and secure each of the counter flashing members 30 around the chimney 20 to form the counter flashing assembly 26, initially each of the counter flashing members 30 is trimmed to fit the sides 20*a*–20*d* of the chimney 20 by cutting the members 30 to conform to the shape of the chimney 20 and the slope of the roof 22 relative to the chimney 20. The members 30 are cut such that the flanges 48 on each member 30 are positioned at the same level around the chimney 20, and one end of each member 30 opposite the receiver joint 46 extends outwardly past the adjacent edge of the chimney 20 a short distance to effectively surround the chimney 20 and provide an aesthetically pleasing appearance to the flashing 24. Also, the members 30 are trimmed so that each member 30 covers approximately one-half of the shingles 32 and base flashing members 34 located below each member 30 to prevent water from flowing between the chimney 20 and the shingles 32 and/or base flashing members 34.

The outwardly extending part of each member 30 opposite the receiver joint 46 is bent to form a locking flange 56 on each counter flashing member 30 opposite the locking receiver joint 46. The locking flange 56 has an overall length less than that of the receiving slot 50 such that the locking flange 56 can be aligned with and fully inserted into the slot 50. Once the locking flange 56 is inserted into the receiving slot 50, as shown in FIG. 6, the locking tab 52 is bent towards the aligning flange 54 over the receiving slot 50 as shown by arrow A in FIG. 6 in order to engage and retain the locking flange 56 within the receiving slot 50. The remaining counter flashing members 30 are engaged with one another in this manner until the entire periphery of the chimney 20 is encircled by the counter flashing members 30.

Once the counter flashing members 30 have been engaged with one another to form the counter flashing 26, the sealing flanges 48 on each counter flashing member 30 are sealingly engaged with the chimney 20 in order to prevent precipitation from flowing downwardly between the counter flashing members 30 and the chimney 20. In one embodiment, as best shown in FIGS. 4 and 5, a sealing element 58, i.e., a waterproof sealing material, such as caulk, is placed between the sealing flange 48 and each end of the chimney 20 to provide a waterproof seal between the sealing flange 48 and the chimney 20. Alternatively, as best shown in FIG. 7, the sealing flange 48 can be unbent in order to insert the flange 48 between two rows of the bricks 21 forming the chimney 20. In this configuration, the flange 48 is retained between the bricks 21 by engagement of the sealing flange 48 within a material 60, such as mortar, which holds the bricks 21 in engagement with one another.

In order to accommodate chimneys of various sizes, the counter flashing members 30, shingles 32 and base flashing members 34 can be formed to have an overall length and width appropriate for use with chimneys having standardized sizes, such as chimneys that have sides which are two or three feet in width. Thus, each kit can be configured to be used with a chimney having sides of an appropriate width such that only each of the counter flashing members 30 need be cut in order to accommodate for the slope of the roof 22 relative to the chimney 20. In this manner, each kit containing the assembly 24 can be utilized with chimneys having a specific width for each side, regardless of the slope of the roof 22 based on the fact that each member of the assembly 24 in the kit can be easily adjusted without the need for expensive tools to conform to the slope of the roof 22. Further, the counter flashing members 30 may also be pre-trimmed to conform to a standard slope for the chimney 20, such as a 12/12 slope or a 12/4 slope.

In order to provide an even more aesthetically pleasing appearance to the flashing placed around the chimney 20, the flashing members in the kit can also be colored as desired in order to allow the flashing to "blend into" the overall appearance of the chimney 20 and/or roof 22. The number of base flashing members 34, shingles 32 and counter flashing members 30 can also be changed from the numbers in the preferred embodiments discussed above. For example, the shingles 32 can be reduced in number or eliminated by increasing the size of the base flashing members or member 34 to extend completely around the sides 20*c* and 20*d* of the chimney 20. Similarly, the size of each counter flashing member 30 can be changed so that one member 30 can extend completely around the chimney 20.

Various alternatives and embodiments are contemplated as being within the scope of the following claims particularly pointing out and distinctly claiming the subject matter regarded as the invention.

I claim:

1. A flashing assembly comprising:

a) at least one bent base flashing member adapted to be positioned against a building structure, the at least one base flashing member including a central section and a pair of formable end sections on opposite sides of the central section, said base flashing member formed as a one-piece unitary member; and b) at least one counter flashing member having a locking receiver joint at one end having a foldable locking tab, the at least one counter flashing member adapted to be placed around the building structure over the at least one base flashing member.

2. A flashing assembly comprising:

a) at least one bent base flashing member adapted to be positioned against a building structure, the at least one base flashing member including a central section and a pair of flexible end sections on opposite sides of the central section; and b) at least one counter flashing member having a locking receiver joint at one end, the at least one counter flashing member adapted to be placed around the building structure over the at least one base flashing member, wherein the at least one base flashing member includes a flexible center portion on the central section.

3. The assembly of claim 2 wherein the flexible center portion is disposed equidistant from the end sections.

4. The assembly of claim 2 further comprising a second base flashing member including a central section and a pair of flexible end sections on opposite sides of the central section.

5. The assembly of claim 2 wherein the at least one counter flashing member further includes a sealing flange extending along one side of the at least one counter flashing member between the locking receiver joint and the opposite end of the at least one counter flashing member.

6. The assembly of claim 5 wherein the sealing flange is positioned on a top side of the at least one counter flashing member.

7. The assembly of claim 6 wherein the sealing flange is adapted to be inserted between a number of building elements.

8. The assembly of claim 2 wherein the locking receiver joint includes a locking tab and a receiving slot integrally formed with one another.

9. The assembly of claim 8 wherein the locking tab is foldable over the receiving slot.

10. The assembly of claim 8 wherein the locking receiver joint further includes an alignment member integrally formed with the receiving slot opposite the locking tab.

11. The assembly of claim 8 wherein the locking tab and receiving slot are integrally formed with the at least one counter flashing member.

12. The assembly of claim 8 further comprising a locking flange formed on the at least one counter flashing member opposite the locking receiver joint and insertable into the joint.

13. The assembly of claim 8 further comprising four counter flashing members interconnectable with one another to surround the building structure.

14. The assembly of claim 2 further comprising a number of shingles positionable against the building structure on opposite sides of the at least one base flashing member.

15. The assembly of claim 2 wherein the at least one base flashing member and the at least one counter flashing member are contained within a kit.

16. A method for waterproofing a building structure, such as a chimney, the method comprising the steps of:

a) providing a flashing assembly including a first pre-bent base flashing member formed as a one-piece unitary member and having a central section and a pair of formable end sections on opposite sides of the central section, the central section including a formable center portion, a second pre-bent base flashing member having a central section and a pair of formable end sections on opposite sides of the central section, and at least one counter flashing member formed as a one-piece unitary member having a locking receiver joint at one end;

b) placing the first base flashing member against the building structure;

c) placing the second base flashing member against the building structure opposite the first base flashing member; and d) securing the at least one counter flashing member around the building structure over the first and second base flashing members.

17. The method of claim 16 wherein the step of placing the first base flashing member against the building structure comprises flexing the central section about the center portion to conform the first base member to the shape of the building structure.

18. The method of claim 16 wherein the step of securing the at least one counter flashing member comprises the steps of:

a) forming a locking flange on the at least one counter flashing member opposite the locking receiver joint; and b) engaging the locking flange with the locking receiver joint.

19. The method of claim 18 wherein the locking receiver joint includes an aligning flange, a locking tab and a receiving slot connecting the aligning flange and the locking tab, and wherein the step of engaging the locking flange with the locking receiver joint comprises inserting the locking flange into the receiving slot.

20. The method of claim 19 wherein the locking tab is foldable with respect to the receiving slot, and further comprising the step of folding the locking tab over the slot after inserting the locking flange into the slot.

21. The method of claim 16 wherein the assembly includes a number of counter flashing members and the step of securing the at least one counter flashing member comprises:

a) forming a locking flange on each of the counter flashing members;

b) placing a first counter flashing member against one side of the building structure;

c) placing a second counter flashing member against the side of the building structure adjacent the first counter flashing member such that the locking flange on the second member is inserted within the locking receiver joint on the first member;

d) securing the locking flange within the locking receiver joint; and e) successively placing and engaging the remaining counter flashing members with one another to encircle the building structure.

22. The method of claim 16 wherein the assembly includes a number of tin shingles and further comprising the step of placing the tin shingles against the building structure between the first and second base flashing members after placing the second base flashing member against the building structure.

23. The method of claim 16 further comprising the step of adjusting the bend in each of the first base flashing member, second base flashing member, and at least one counter flashing member to conform each member to the configuration of the building structure and slope of the roof prior to placing the first base flashing member against the building structure.

24. The method of claim 16 wherein the step of providing the flashing assembly comprises placing the first base flashing member, the second base flashing member and the at least one counter flashing member into a kit.

* * * * *